US010704747B2

(12) United States Patent
Romano et al.

(10) Patent No.: US 10,704,747 B2
(45) Date of Patent: Jul. 7, 2020

(54) REDUCED GLARE LIGHT FIXTURE

(71) Applicant: Hubbell Incorporated, Shelton, CT (US)

(72) Inventors: Perry Romano, Bradenton, FL (US); Adam J. Clark, Bradenton, FL (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/752,912

(22) Filed: Jan. 27, 2020

(65) Prior Publication Data

US 2020/0158298 A1 May 21, 2020

Related U.S. Application Data

(63) Continuation of application No. 15/964,153, filed on Apr. 27, 2018, now Pat. No. 10,551,015.

(Continued)

(51) Int. Cl.

| | |
|---|---|
| ***F21S 2/00*** | (2016.01) |
| ***F21V 29/74*** | (2015.01) |
| ***F21V 3/06*** | (2018.01) |
| ***F21V 29/76*** | (2015.01) |
| ***F21V 21/30*** | (2006.01) |
| ***F21V 23/00*** | (2015.01) |
| ***F21V 17/00*** | (2006.01) |
| *F21W 131/407* | (2006.01) |

(Continued)

(52) U.S. Cl.

CPC ..... *F21S 2/005* (2013.01); *F21V 3/0625* (2018.02); *F21V 17/002* (2013.01); *F21V 21/30* (2013.01); *F21V 23/007* (2013.01); *F21V 29/74* (2015.01); *F21V 29/763* (2015.01); *F21S 8/08* (2013.01); *F21V 5/007* (2013.01); *F21W 2131/105* (2013.01); *F21W 2131/407* (2013.01); *F21Y 2105/12* (2016.08); *F21Y 2113/13* (2016.08); *F21Y 2115/10* (2016.08)

(58) Field of Classification Search

CPC ..... F21V 29/74; F21V 29/763; F21V 3/0625; F21V 14/002; F21V 21/30; F21V 23/007; F21S 2/005

See application file for complete search history.

(56) References Cited

U.S. PATENT DOCUMENTS 5,599,091 A * 2/1997 Kira ..... F21V 21/30 362/269

5,938,324 A 8/1999 Salmon et al.

(Continued)

OTHER PUBLICATIONS

Sievers, "Fundamentals of LED Light Pipes," Electronic Design 2013, Retrieved from the Internet https://www.electronicdesign.com/components/fundamentals-led-light-pipes, May 8, 2013, 7 pages.

*Primary Examiner* — Anabel Ton

(74) *Attorney, Agent, or Firm* — Michael Best & Friedrich, LLP

(57) ABSTRACT

Reduced glare light fixtures are provided. In one example implementation, a reduced glare light fixture includes a light emitting diode (LED) system. The LED system includes at least one LED module having one or more LED devices. The reduced glare light fixture further includes a bezel physically coupled to the LED system engine. The bezel has one or more glare reduction tubes. At least one of the one or more glare reduction tubes is configured to be approximately coaxial with one LED of the one or more LED devices.

16 Claims, 14 Drawing Sheets

Related U.S. Application Data

(60) Provisional application No. 62/613,959, filed on Jan. 5, 2018, provisional application No. 62/501,959, filed on May 5, 2017.

(51) Int. Cl.

| | |
|---|---|
| *F21Y 113/13* | (2016.01) |
| *F21S 8/08* | (2006.01) |
| *F21W 131/105* | (2006.01) |
| *F21Y 115/10* | (2016.01) |
| *F21V 5/00* | (2018.01) |
| *F21Y 105/12* | (2016.01) |

(56) References Cited

U.S. PATENT DOCUMENTS

| | | | | |
|---|---|---|---|---|
| 5,988,842 | A | 11/1999 | Johnsen et al. | |
| 6,779,907 | B2 * | 8/2004 | Beadle | F21S 8/024 362/145 |
| 6,942,363 | B1 * | 9/2005 | LeVasseur | F21V 14/04 362/267 |
| 7,182,486 | B1 * | 2/2007 | Miracle | F21S 6/003 362/346 |
| 8,585,250 | B1 | 11/2013 | Kim | |
| 9,115,857 | B2 * | 8/2015 | Beausoleil | F21S 8/032 |
| 9,995,439 | B1 * | 6/2018 | Shum | F21V 17/105 |
| 10,036,534 | B2 | 7/2018 | Morello | |
| 10,228,098 | B2 | 3/2019 | Berkeljon | |
| 10,386,057 | B2 | 8/2019 | Harvey | |
| 2012/0155080 | A1 | 6/2012 | Schupple et al. | |
| 2012/0206918 | A1 | 8/2012 | Lee | |
| 2013/0176707 | A1 | 7/2013 | Audette | |
| 2013/0329409 | A1 | 12/2013 | Windom et al. | |
| 2014/0168991 | A1 | 6/2014 | Kim | |
| 2014/0210357 | A1 | 7/2014 | Yan et al. | |
| 2014/0293603 | A1 | 10/2014 | Barnard et al. | |
| 2015/0167931 | A1 * | 6/2015 | Borgarelli | F21V 7/00 362/297 |
| 2016/0047538 | A1 | 2/2016 | Peck | |
| 2016/0319996 | A1 * | 11/2016 | Moon | F21K 9/233 |
| 2017/0184288 | A1 | 6/2017 | Owens | |
| 2018/0224111 | A1 | 8/2018 | Emerson | |
| 2018/0340683 | A1 | 11/2018 | Harvey et al. | |
| 2019/0086047 | A1 | 3/2019 | Jiang | |
| 2019/0120445 | A1 | 4/2019 | Casper | |
| 2019/0195485 | A1 | 6/2019 | Harvey | |

* cited by examiner

REDUCED GLARE LIGHT FIXTURE

REFERENCE TO RELATED APPLICATIONS

Priority Claim

This application is a continuation of U.S. patent application Ser. No. 15/964,153, filed on Apr. 27, 2018, titled "REDUCED GLARE LIGHT FIXTURE,", which is based on and claims the benefit of priority to U.S. Provisional Application No. 62/501,959, filed on May 5, 2017, titled "LIGHTING FIXTURE," and U.S. Provisional Application No. 62/613,959, filed on Jan. 5, 2018, titled "REDUCED GLARE LIGHT FIXTURE," both of which are incorporated herein by reference.

FIELD

The present disclosure relates generally to artificial lighting.

BACKGROUND

Artificial lighting is important to many aspects of modern life. For example, artificial lighting can be important for many different sporting competitions and sporting venues. While artificial lighting often allows participation in indoor sports, and outdoor sports in darkened conditions, artificial lighting is not without drawbacks. Glare is currently one of the biggest complaints about sports lighting. The problem of glare is not limited to sporting venues either. For example, flood lighting used around various structures and airport ramp lighting are often the subject of complaints about glare.

Glare and related light trespass are of special concern when installing floodlights. Disability glare reduces visual performance and visibility. Discomfort glare produces physical discomfort. It is possible to experience disability without discomfort, and conversely, discomfort without disability, however, one often accompanies the other. Regarding light that we actually see, brightness can be measured as the light leaving a lamp, or the light reflecting from an object's surface. It is measured in footlamberts (English) or candelas/square meter (metric). In practice, glare is usually a situation where a source of unshielded light is at least 1,000 times brighter than the average visual field. For instance, because the night sky is dark, almost all outdoor light sources, such as a street luminaire or automobile headlight, cause glare. To evaluate glare, however, one may use luminance, which typically is measured in candelas per square meter (cd/m2) or nits.

As used herein, the term glare includes all forms of glare, including discomfort glare and disability glare, as well as light trespass, and related stray light problems. For example, ocular stray light is a phenomenon where parts of the human eye scatter light that reaches the retina, but do not contribute to forming a correct image.

One approach to reducing glare is to decrease light intensity of the artificial light source. However, if the decreased light intensity cannot be offset with additional lighting fixtures, overall lighting may drop below acceptable levels. Even if decreased light intensity is offset with additional lighting fixtures, such additional lighting fixtures typically incur a corresponding increase in costs.

Another approach to reducing glare is to use louvers, such as various types of blade and concentric louvers. Unfortunately, louvers have the effect of reducing light output and correspondingly increasing costs to compensate for the loss of light by producing additional lumens of light to offset the losses.

SUMMARY

Aspects and advantages of embodiments of the present disclosure will be set forth in part in the following description, or may be learned from the description, or may be learned through practice of the embodiments.

One example aspect of the present disclosure is directed to a-light engine module having at least one light emitting source. The light engine module can include a bezel comprising at least one glare reduction tube configured to be approximately coaxial with the at least one light emitting source.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
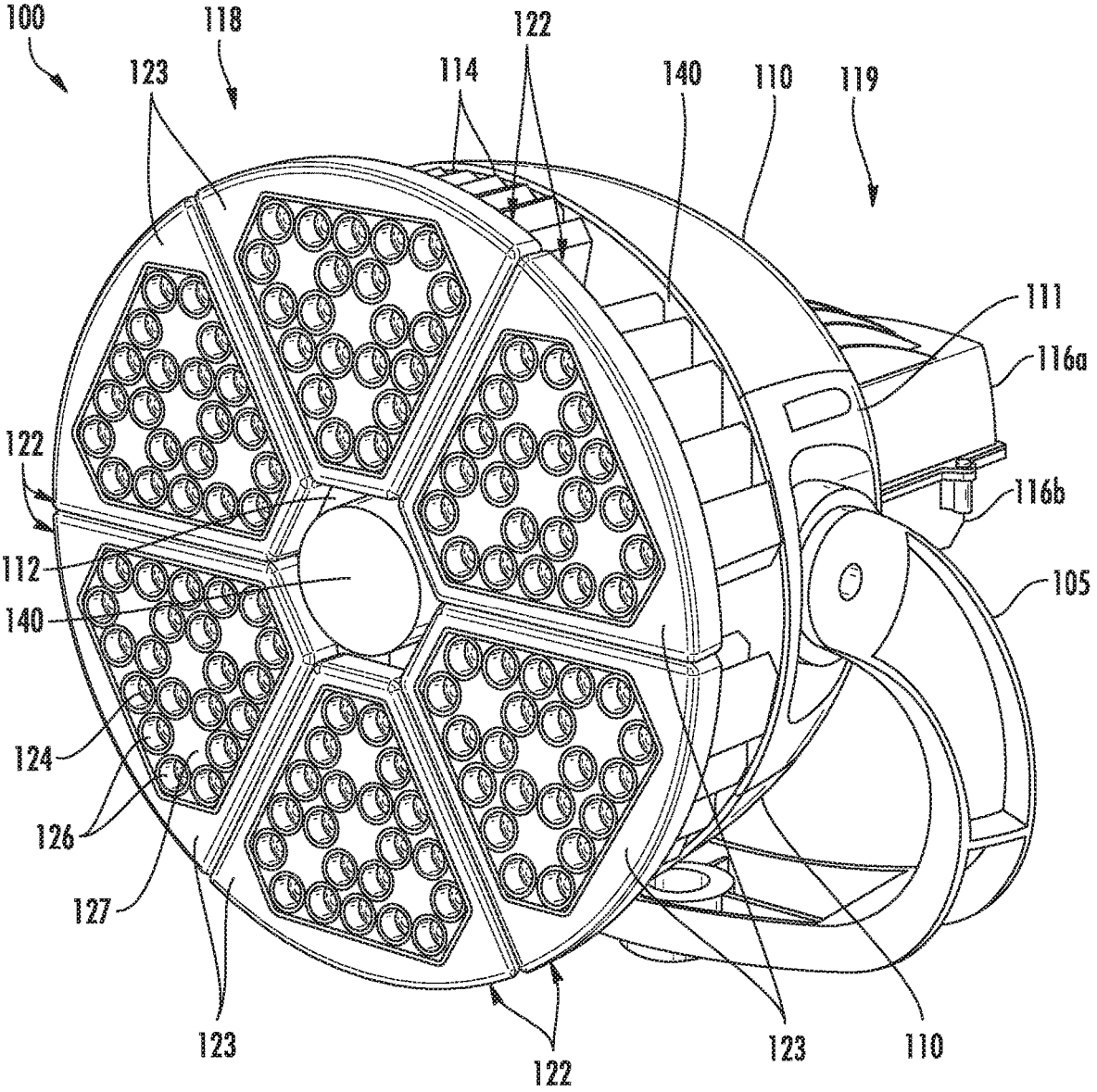
FIG. 1 is a front, perspective view of an example reduced glare light fixture according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to reduced glare light fixtures mitigating glare associated with LED lighting. As described herein, some embodiments include a bezel having glare reducing tubes formed therein positioned over a light engine module having LED devices such that the LED devices are approximately coaxial with the glare reducing tubes to reduce glare. In some embodiments, reduced glare light fixtures described herein mitigate or prevent direct view of particularly bright parts of lighting, such as with floodlights. In some embodiments, the reduced glare light fixtures mitigate or eliminate stray lumens that cause glare without overly reducing the lumens in a main light beam otherwise intended for illumination purposes.

Referring to FIGS. 1-15, and in particular to FIG. 1, a front, perspective view of an example embodiment of a reduced glare light fixture 100 according to the present disclosure is shown. The reduced glare light fixture 100 includes a mounting yoke 105. In some embodiments, the mounting yoke 105 enables the reduced glare light fixture 100 to be physically coupled through a pole to a large structure or ground support. In some embodiments, the mounting yoke 105 is physically coupled to a housing 110 through an optional yoke mount portion 111 of the housing 110. In some embodiments, the reduced glare light fixture 100 includes a plurality of heat sinks 112 each having a plurality of fins 114 generally disposed in front of an upper driver casing 116*a* and a lower driver casing 116*b*. In some alternative embodiments, the upper driver casing 116*a* and the lower driver casing 116*b* are omitted. For orientation purposes, the physically coupled upper driver casing 116*a* and the lower driver casing 116*b* are positioned towards a rear portion 119 of the reduced glare light fixture 100 and the heatsinks 112 are positioned towards a front portion 118 of the reduced glare light fixture 100.

In some embodiments, the upper driver casing 116*a* is physically coupled to the lower driver casing 116*b* through fasteners, such as bolts, and recessed sockets. However, unless specifically stated otherwise, neither physically connected components, nor physically coupled components, are not limited to any particular form of component attachment. For example, in some embodiments, the upper driver casing 116*a* is physically coupled to the lower driver casing 116*b* through mating surfaces. In some embodiments, the upper driver casing 116*a* is physically coupled to the lower driver casing 116*b* with adhesives. In some embodiments, the upper driver casing 116*a* and the lower driver casing 116*b* are formed as a single driver casing 116 component.

In some embodiments, the housing 110 can include a grill 113. To provide air flow to heat sinks 112, the grill 113 can extend around the heat sinks 112 along a circumferential direction C on housing 110, and the grill 113 can also be aligned with the heat sinks 112 along a radial direction R. As an example, the grill 113 can be positioned coplanar with the heat sinks 112, e.g., in a plane that is perpendicular to an axial direction A such that the plane intersects both the grill 113 and the heat sinks 112. In some embodiments, a length of the grill 113, e.g., along the axial direction A, may also be about equal to a length of the fins 114 of the heat sinks 112, e.g., along the axial direction A. In this manner, the grill 113 can facilitate cooling air flow into and out of housing 110. For example, the grill 113 can be perforated such that air may flow through the housing 110 at the grill 113 to and/or from the heat sinks 112. In particular, cooler air may flow through the grill 113 into the housing 110 below the heat sinks 112, whereas warmer air may flow through the grill 113 out of housing 110 above the heat sinks 112.

The reduced glare light fixture 100 includes a light-emitting diode (LED) system 120. The LED system 120 includes a plurality of light engine modules 122. While six light engine modules 122 are shown in FIG. 1, and two to twelve light engine modules are preferred, the particular number of light engine modules is not expressly limited. In some embodiments, each light engine module has a common shape such that an integral number of modules placed adjacent to each other form a ring. Although the plurality of light engine modules 122 are not limited to a common shape, the use of a common shape simplifies certain manufacturing and assembly steps.

Each light engine module 122 includes a bezel 123, a plurality of optics 124, and a plurality of LED devices (not illustrated). In some embodiments, the bezel 123 is formed separately from the light engine modules 122 and attached after formation. In some embodiments, the bezel 123 includes a plurality of glare reduction tubes 126. More specifically, each glare reduction tube of the plurality of glare reduction tubes 126 is hollow and enables light to pass from the one optic 124 and one LED device. In some embodiments, the plurality of glare reduction tubes 126 are integrally formed with the bezel 123. For instance, the plurality of glare reduction tubes 126 and the bezel 123 can be formed as a single monolithic component. Alternatively, the plurality of glare reduction tubes 126 and the bezel 123 can be formed as separate components. In this manner, the plurality of glare reduction tubes 126 can be removably coupled to the bezel 123.

In some embodiments, as shown in FIG. 1, the bezel 123 contains 21 glare reduction tubes 126, 21 optics 124 and 21 LED devices. In some embodiments, as shown in FIG. 1, one optic 124 and one LED device can be recessed within one glare reduction tube 126 for all of the optics, LED devices and tubes. In some embodiments, each optic 124 and LED device are recessed within each glare reduction tube 126 such that a light beam from the LED device in an active state has an approximately 50 degree spread from a coaxial center axis, i.e., approximately 25 degrees spread on each of 2 opposing sides of the coaxial center axis. In some embodiments, the plurality of optics 124 are fabricated together as a single component separate from the bezel 123. In some alternative embodiments, the plurality of optics 124 are each fabricated as separate, individual components.

As shown in FIG. 1, the bezel 123 includes a surface 127. In some embodiments, the surface 127 can be a base of the bezel 123. The plurality of glare reduction tubes 126 can be associated with the surface 127 of the bezel 123. For example, the plurality of glare reduction tubes 126 can extend from the surface 127. Alternatively, the plurality of glare reduction tubes 126 can extend through the surface 127. In some embodiments, the surface 127 of the bezel 123 can be comprised of opaque material. Alternatively, the surface 127 of the bezel 123 can be comprised of translucent material. In some embodiments, the surface 127 of the bezel 123 can be positioned over a plurality of light emitting sources (e.g., LED devices) such that each glare reduction tube 126 is aligned with one light emitting source of the plurality of light emitting sources.

As used herein, the terms "about, "approximate," "approximately," and the like, when used in conjunction with a numerical value are intended to refer to any number within twenty five percent (25%) of the stated numerical value. In some embodiments, each optic 124 and LED device are recessed approximately 0.8 inches within each tube 126. In general, in some embodiments, the depth of the recess is a variable dependent on the width of the light beam spread. For example, a more narrow light beam has a deeper recess than a wider light beam. In some embodiments, to reduce glare, the bezel 123, including each glare reduction tube of the plurality of glare reduction tubes 126 in the bezel 123, are formed from a translucent material that diffuses light from the LED devices. In some embodiments, the bezel 123 is formed from a material selected from an acrylic compound and polycarbonate. Some light from the LED devices passes through and is diffused by the translucent material in the bezel 123 before being emitted by the reduced glare light fixture 100. It has been discovered that, under certain conditions, observers viewing the reduced glare light fixture 100 from some angles offset to an outward axial direction A, i.e., the normal axis for the reduced glare light fixture 100, report a significant reduction in glare from the reduced glare light fixture as opposed to comparable light fixtures without the bezel 123. Note that the outward axial direction A is generally in the direction from the rear portion 119 to the front portion 118. One possible explanation for the apparent reduction in glare is thought to be due to smoothing contrast between light from the LED devices passing through each of the glare reduction tubes 126 effectively reduces glare for an observer at certain distances and angles.

In some embodiments, to reduce glare, the bezel 123, including each of the plurality of glare reduction tubes 126 in the bezel 123, are formed from an opaque material that blocks light from the LED devices. In some embodiments, the opaque material is black. In this manner, the bezel 123 can block light emitted from the LED devices before said light can be emitted by the reduced glare light fixture 100. It has been discovered that, under certain conditions, observers viewing the reduced glare light fixture 100 from some angles offset to axial direction A, i.e., the normal axis for the reduced glare light fixture 100, report a significant reduction in glare from the reduced glare light fixture as opposed to comparable light fixtures without the bezel 123. It is thought that the reduction of light emitted at angles offset to the axial direction A passing through the tubes 126 from the LED devices reduces glare for an observer.

Each optic 124 in the reduced glare light fixture 100 is optically coupled with one of the plurality of LED devices. In some embodiments, each optic 124 is a lens used to help direct light from the plurality of LED devices in the axial direction A out of the reduced glare light fixture 100. One or more examples of the optic 124 are shown in the figures, but the optic 124 is not limited to any particular shape. Each optic 124 is positioned over one LED device of the plurality of LED devices. For example, the optic 124 shown in FIG. 11 includes a LED receptacle portion 128 for receiving one LED device of the plurality of LED devices. In some embodiments, the arrangement of optics 124, the LED devices and the glare reduction tubes 126 are configured to provide a variety of different light distributions, such as a type I distribution, type II distribution, type III distribution, type IV distribution, type V distribution, e.g., round, square, round wide, other light distribution, or combination of light distributions. In some embodiments, the optics 124, the LED devices and the glare reduction tubes 126 are configured to provide one of flood optics, such as a 2×2 beam pattern, a 3×3 beam pattern, a 4×4 beam pattern, a 5×5 beam, pattern, and a 6×6 beam pattern. In some embodiments, the LED devices on each light engine module 122 may have different individualized light distributions. In some embodiments, the plurality of optics 124 are connected and/or formed together on the module support board 170 such that the optics 124 are formed from one separate piece of material.

Figure 12A:
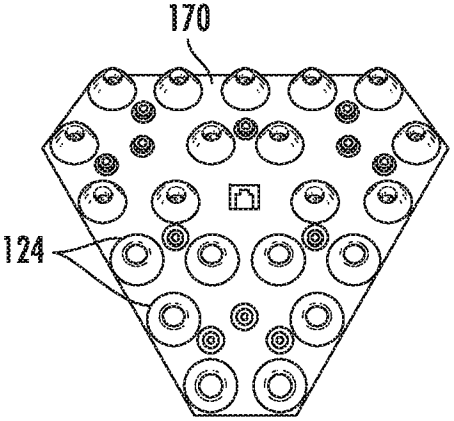
FIG. 12A is a front, perspective view of an inactive module support board of an example reduced glare light fixture according to example embodiments of the present disclosure.
Figure 12B:
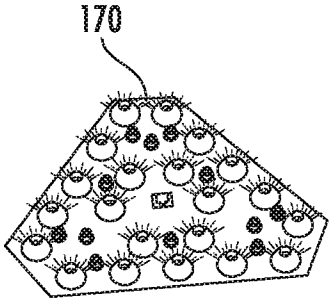
FIG. 12B is a front, perspective view of an active module support board of an example reduced glare light fixture according to example embodiments of the present disclosure.

Turning to FIGS. 12A and 12B, in some embodiments, the reduced glare light fixture 100 includes the plurality of light engine modules 122, and each of the plurality of light engine modules 122 includes the plurality of LED devices mounted on a module support board 170. In some embodiments, the module support board 170 is a printed circuit board (PCB). In some embodiments, the module support board 170 is an LED board. The plurality of LED devices are configured to emit visible light because of movement of electrons between p-type and n-type semiconductor materials. The plurality of—LED devices can have—any suitable size, color, color temperature, etc. for the desired light applications. In some embodiments, the plurality of LED devices are selected from color temperatures of 3000K, 4000K, 5000K and other suitable color temperatures, however, the LEDs are not restricted to any particular color temperature. In some embodiments, the plurality of LED devices include subgroups each having a different set of color temperatures. As shown in FIG. 12A, the 21 LEDs in the plurality of LED devices are in an "off" (inactive state) condition. As shown in FIG. 12B, the 21 LEDs in the plurality of LED devices are in an "on" (active state) condition suitable for illumination purposes.

While some embodiments are described herein as including an LED system 120 as a light engine, it is understood that halogen lights are substituted for the LED system in some alternative embodiments and incandescent lights are substituted for the LED system in some other alternative embodiments. The reduced glare light fixture 100 is not limited to any particular form of light emitting source.

Figure 13A:
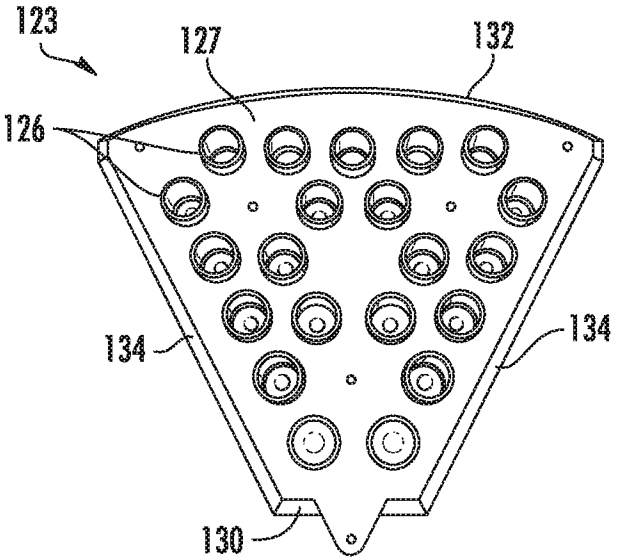
FIG. 13A is a front, perspective view of an inactive light engine module of an example reduced glare light fixture according to example embodiments of the present disclosure.
Figure 13B:
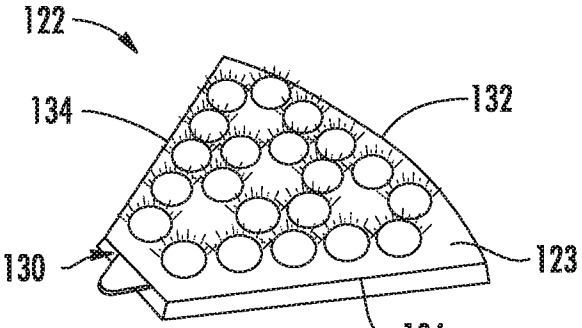
FIG. 13B is a front, perspective view of an active light engine module of an example reduced glare light fixture according to example embodiments of the present disclosure.

Turning to FIGS. 13A and 13B, in some embodiments, each of the plurality of light engine modules 122 includes the bezel 123 that is attached to the module support board 170 such that each of the plurality of glare reduction tubes 126 coaxially aligns with an optic 124 and an LED device. In some embodiments, the bezel 123 includes the plurality of glare reduction tubes 126, each glare reduction tube being optically coupled with one optic 124 and one LED device such that each of the plurality of glare reduction tubes 126 enables light to pass from the one optic 124 and one LED device. In some embodiments, as shown in FIGS. 13A and 13B, the bezel 123 contains 21 glare reduction tubes 126, 21 optics 124 and 21 LED devices. As shown in FIG. 13A, the 21 LEDs included in the plurality of LED devices are in an "off" (inactive state) condition. As shown in FIG. 13B, the 21 LEDs included in the plurality of LED devices are in an "on" (active state) condition suitable for illumination purposes. FIGS. 12B and 13B are positioned side-by-side to help illustrate the reduction in glare between the LEDs 125 without the bezel 123 as shown in FIG. 12B and the LEDs with the bezel as shown in FIG. 13B.

Figure 5:
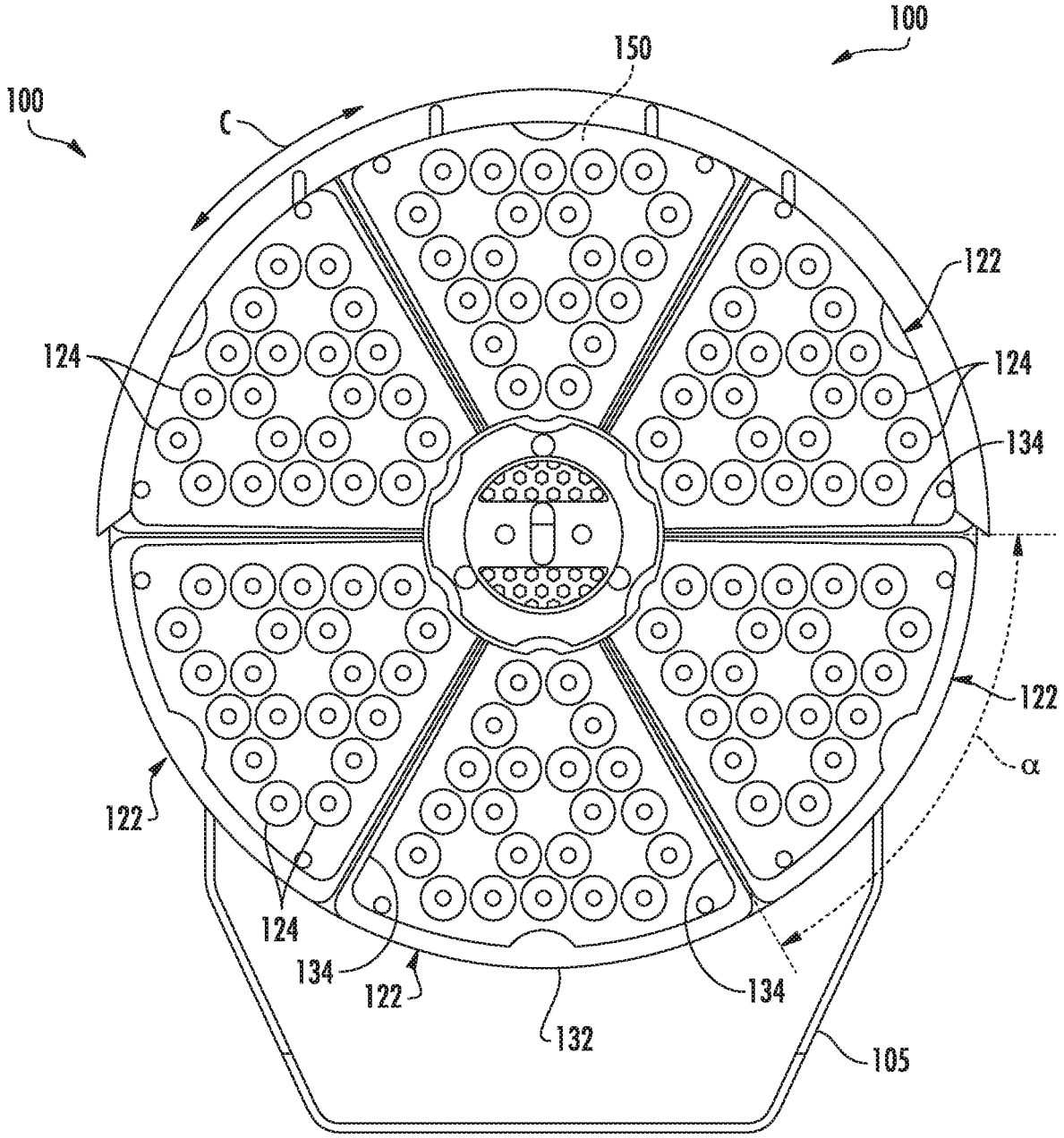
FIG. 5 is a front, elevation view of an example reduced glare light fixture according to example embodiments of the present disclosure.
Figure 6:
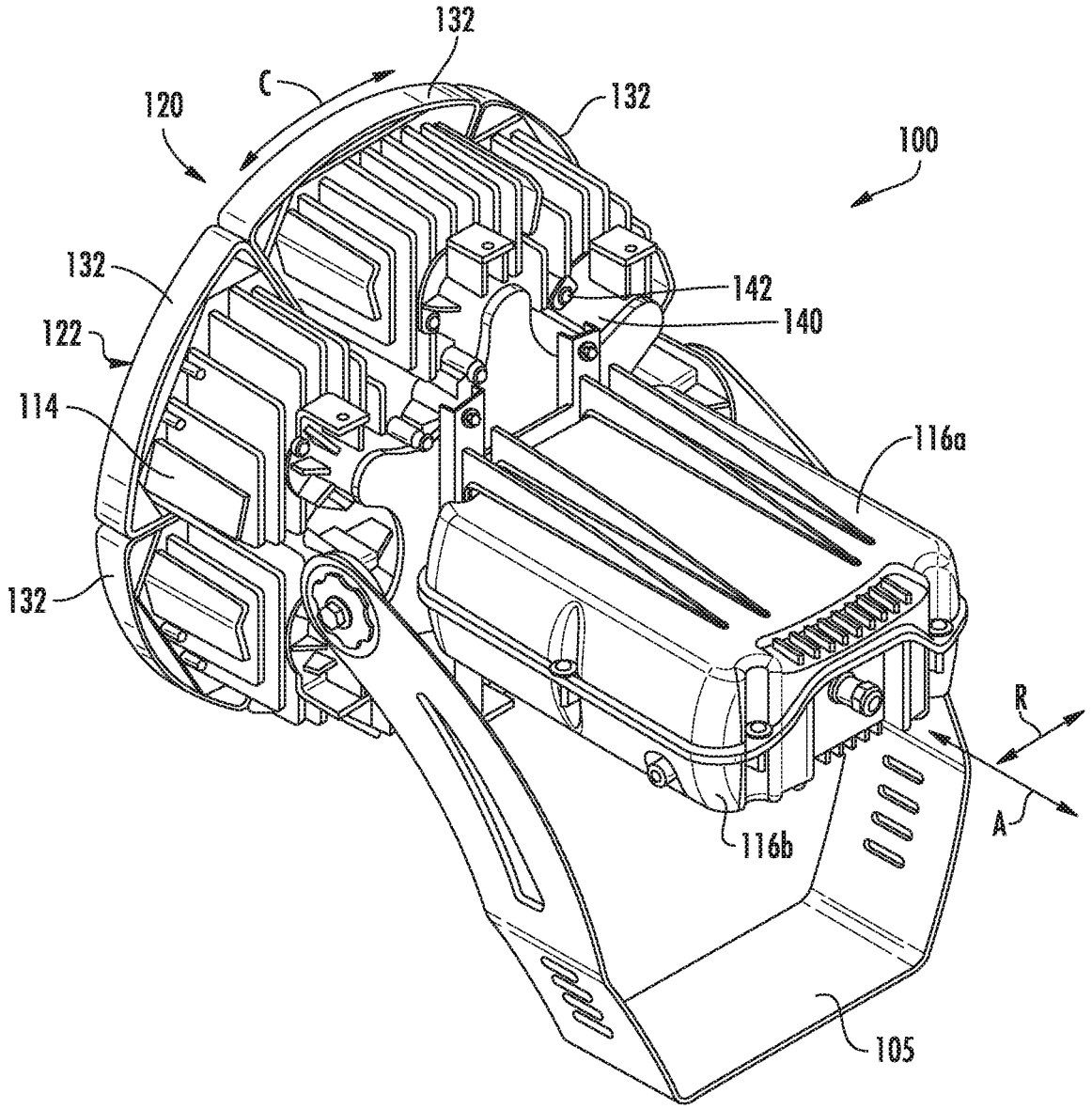
FIG. 6 is a rear, perspective view of certain components of an example reduced glare light fixture according to example embodiments of the present disclosure.
Figure 7:
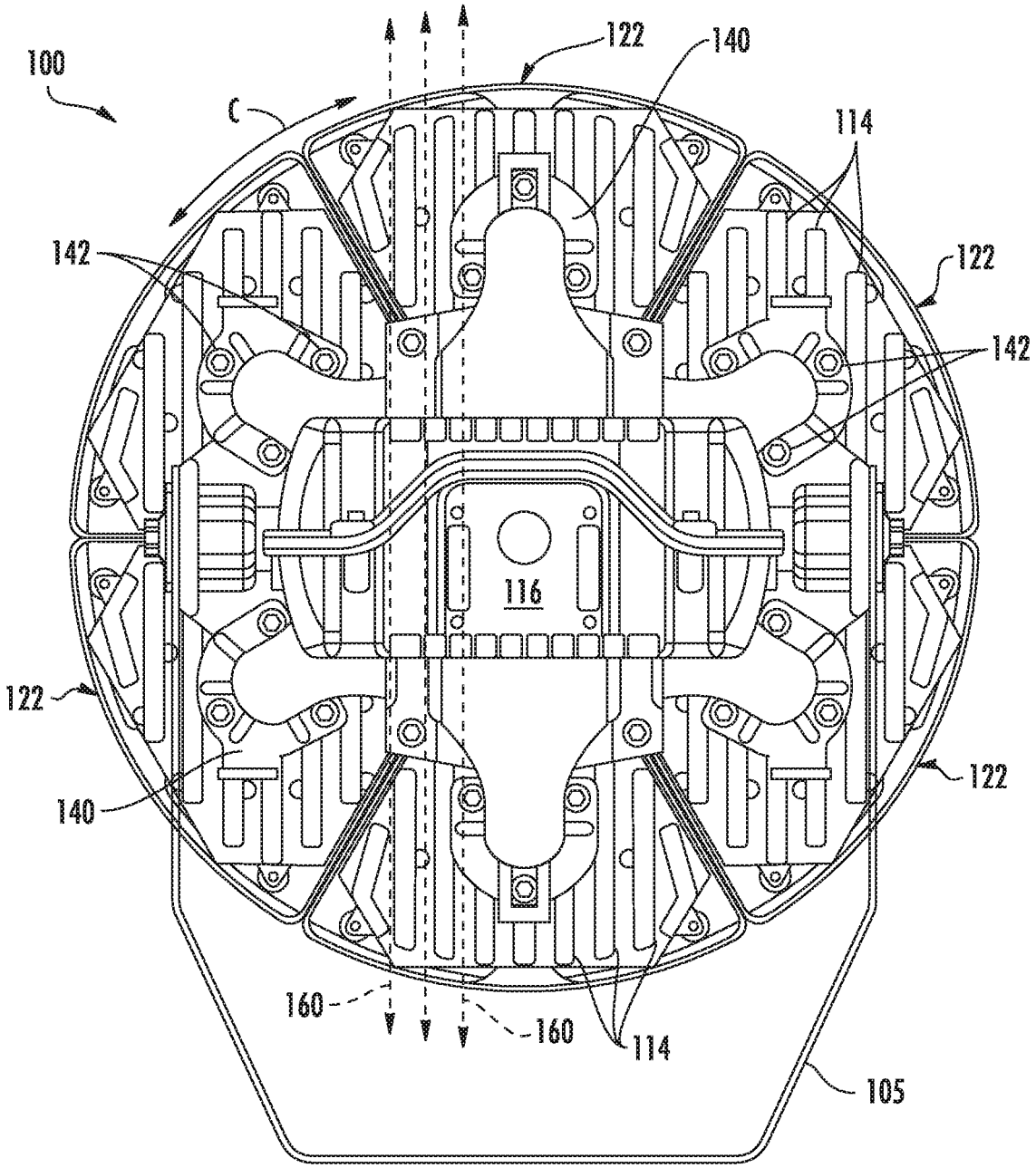
FIG. 7 is a rear, elevation view of certain components of an example reduced glare light fixture according to example embodiments of the present disclosure.
Figure 8:
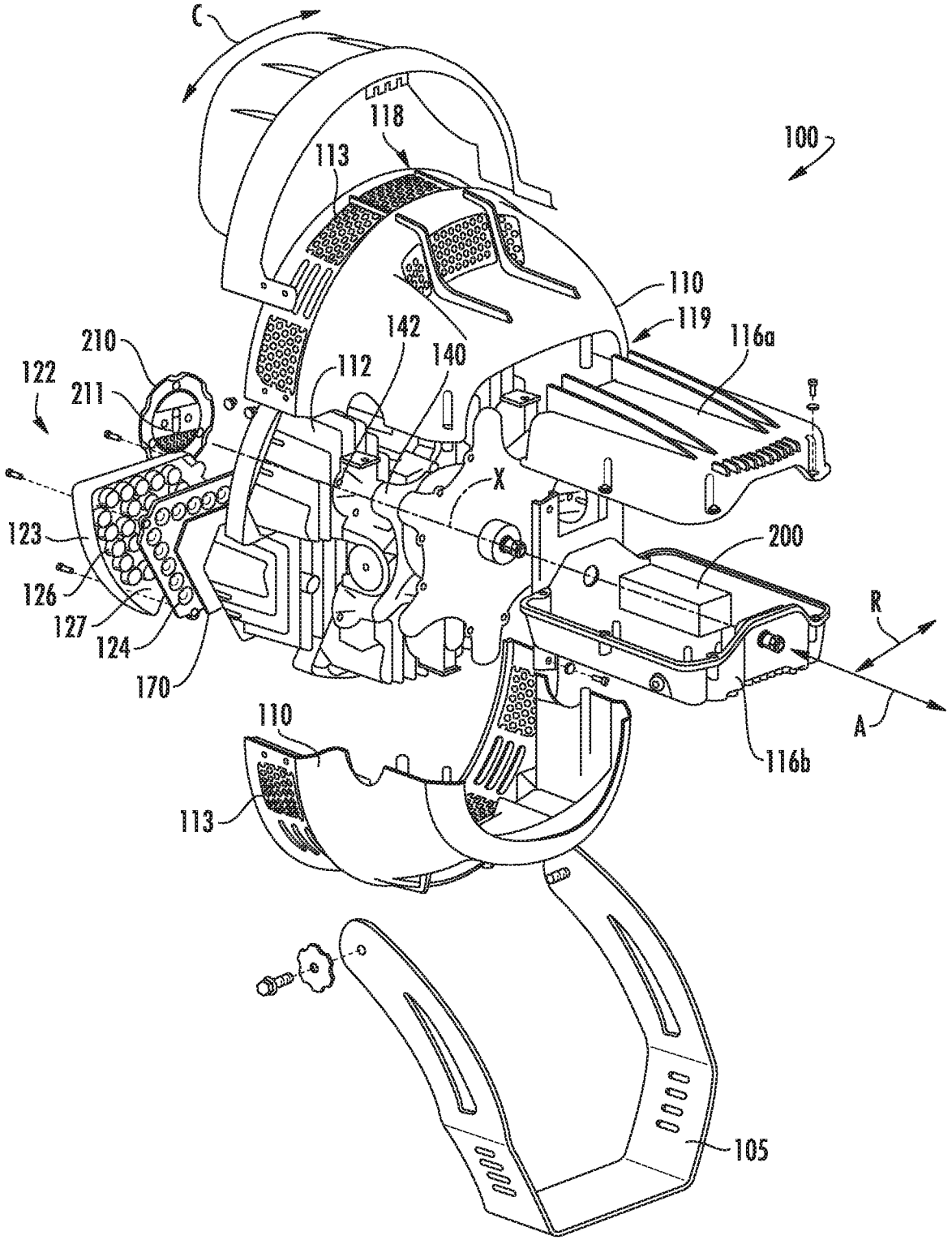
FIG. 8 is a front, exploded view of an example reduced glare light fixture according to the present disclosure.
Figure 9:
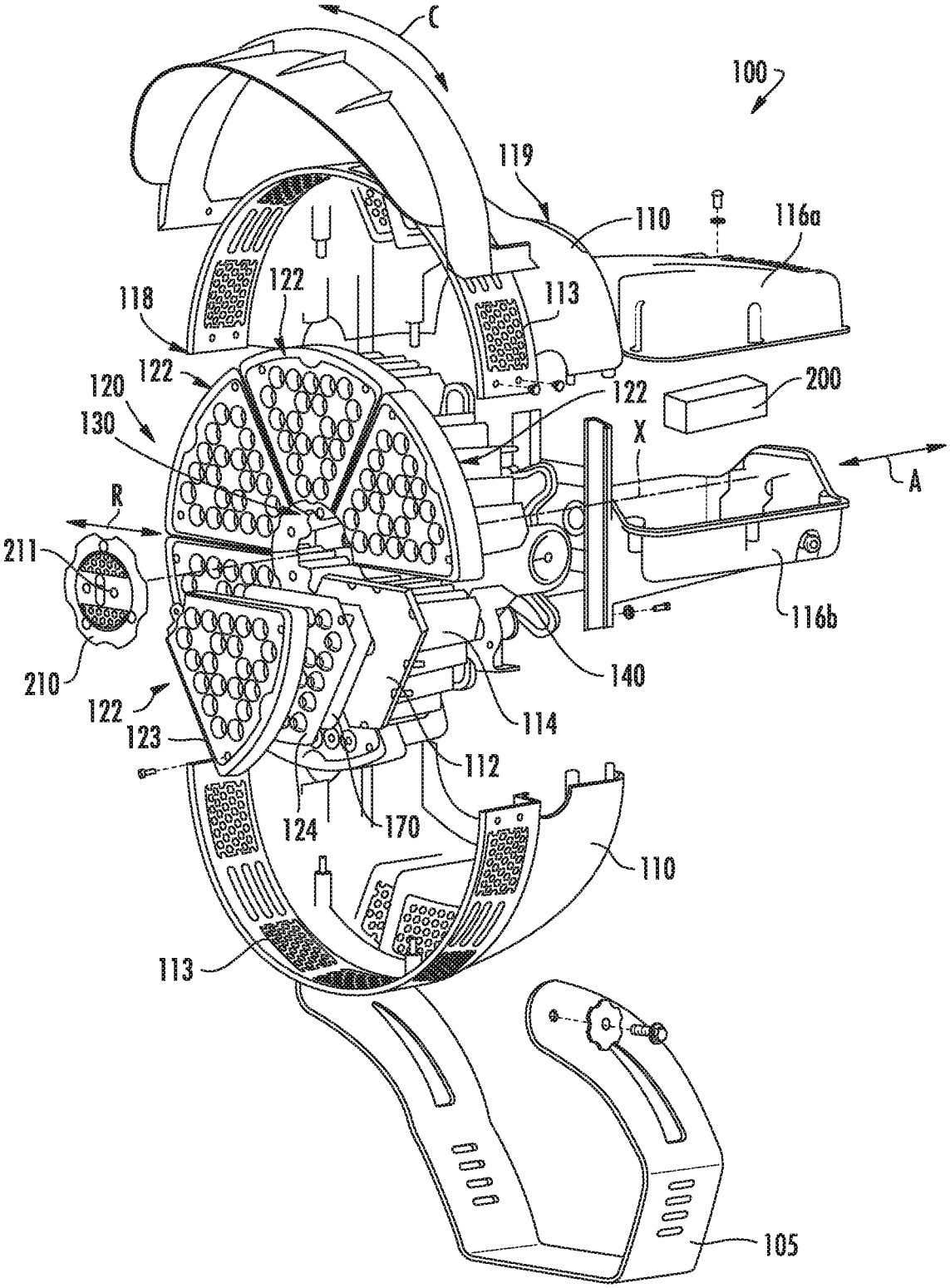
FIG. 9 is a front, exploded view of an example reduced glare light fixture according to example embodiments of the present disclosure.
Figure 10:
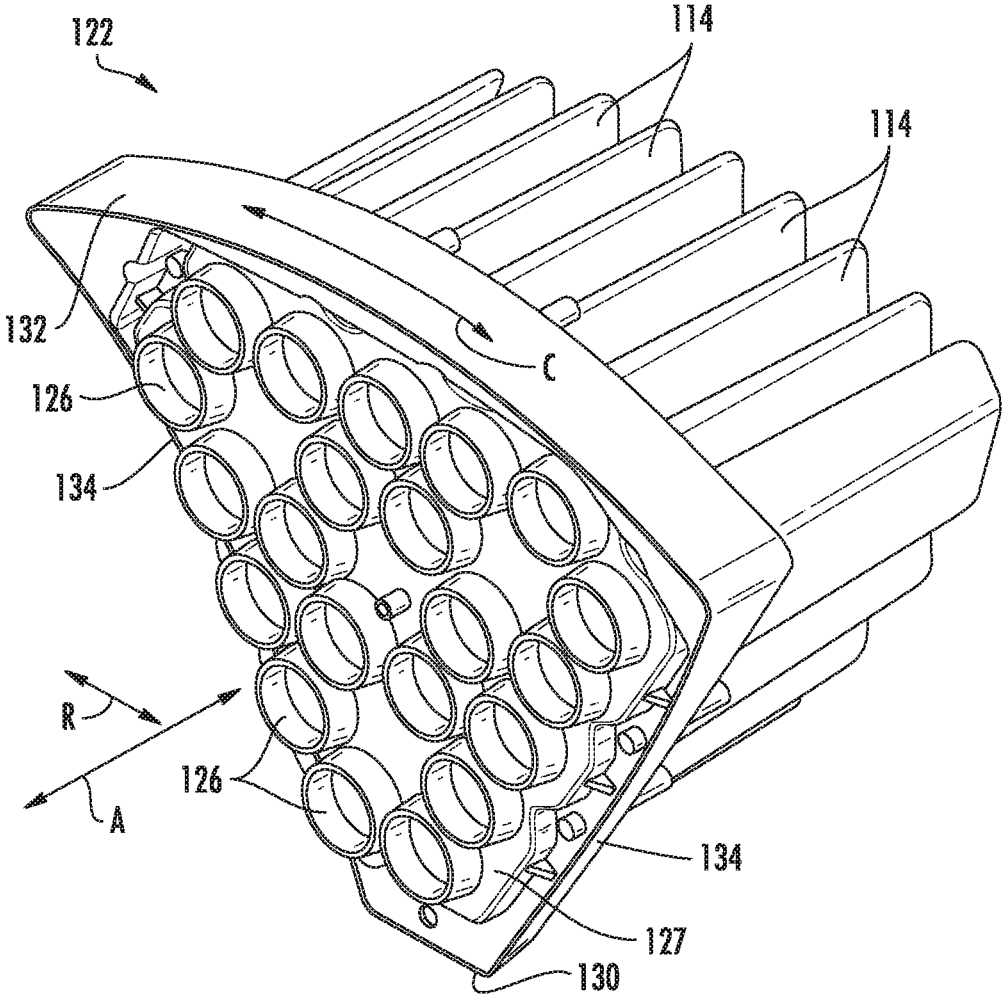
FIG. 10 is a front, perspective view of a module of an example reduced glare light fixture according to example embodiments of the present disclosure.
Figure 11:
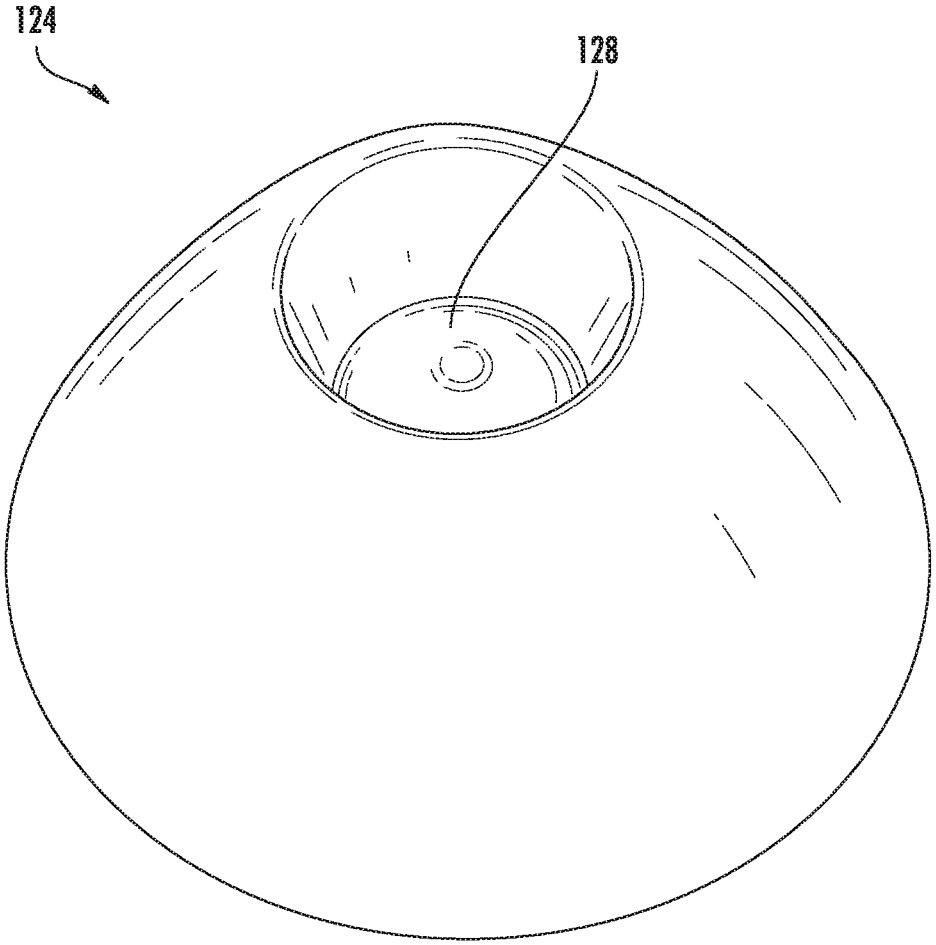
FIG. 11 is a rear, perspective view of an optic of an example reduced glare light fixture according to example embodiments of the present disclosure.

Referring to FIGS. 1-15, and in particular to FIG. 10, in some embodiments, the plurality of light engine modules 122 all have a common size and shape, and are interchangeable with one another, however, the light engines modules are not limited to uniform sizes or uniform shapes. In some embodiments, each of the plurality of light engine modules 122 is wedge shaped and has an inner edge 130 and an outer edge 132. In some embodiments, the inner edge 130 and the outer edge 132 of module 122 are spaced from each other along the radial direction R. In some embodiments, the inner and outer edges 130, 132 of each of the plurality of light engine modules 122 are positioned opposite each other along the radial direction R. For example, as shown in FIG. 9, the inner edge 130 of each of the plurality of light engine modules 122 is radially positioned closest to the center axis A of the LED system 120, and the outer edge 132 of each of the plurality of light modules 122 is radially positioned furthest away from the center axis A of the LED system 120. In some embodiments, the inner edge 130 is disposed proximate a central axis X of housing 110 that extends through the center of LED system 120. In some embodiments, a width W of each of the plurality of light engine modules 122 tapers (e.g., decreases) along the circumferential direction C from the outer edge 132 to the inner edge 130. In some embodiments, each of the plurality of light engine module 122 is narrower along the circumferential direction C, at or adjacent to the center axis of the LED system 120 and wider along circumferential direction C away from the center of LED system 120, such that each of the plurality of light engine modules 122 tapers along the radial direction R. In some embodiments, each of the plurality of light engine modules 122 has a pair of opposing side edges 134. The opposing side edges 134 of each of the plurality of light engine modules 122 may be spaced from each other, e.g., along the circumferential direction C. Thus, the opposing side edges 134 of each of the plurality of light engine modules 122 may be positioned opposite each other along the circumferential direction C. The opposing side edges 134 of each of the plurality of light engine modules 122 may extend, e.g., linearly, along the radial direction R between the inner and outer edges 130, 132. Collectively, inner edge 130, outer edge 132 and side edges 134 of each of the plurality of light engine modules 122 may form a wedge-shaped perimeter, e.g., in a plane that is perpendicular to the axial direction A. When the plurality of lighting modules 122 are wedge shaped and positioned adjacent one another, the plurality of lighting modules 122 may collectively form a circular or arcuate pattern within housing 110. In particular, the opposing side edges 134 of adjacent light engine modules of the plurality of light engine modules 122 may be positioned adjacent and/or contact each other to, as shown in FIG. 5, form the circular or arcuate pattern within housing 110.

Figure 2:
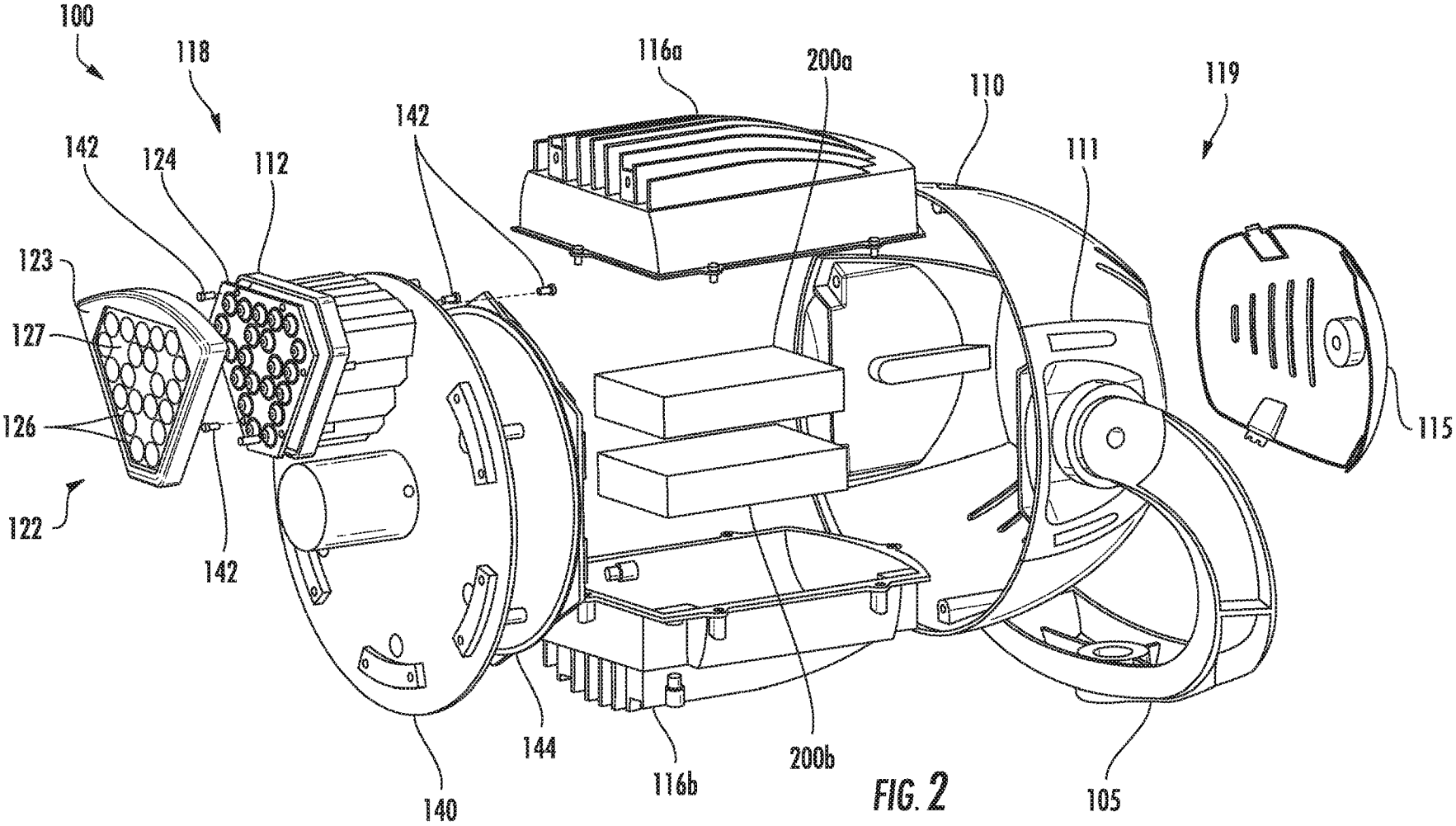
FIG. 2 is an exploded, perspective view of an example reduced glare light fixture according to example embodiments of the present disclosure.
Figure 3:
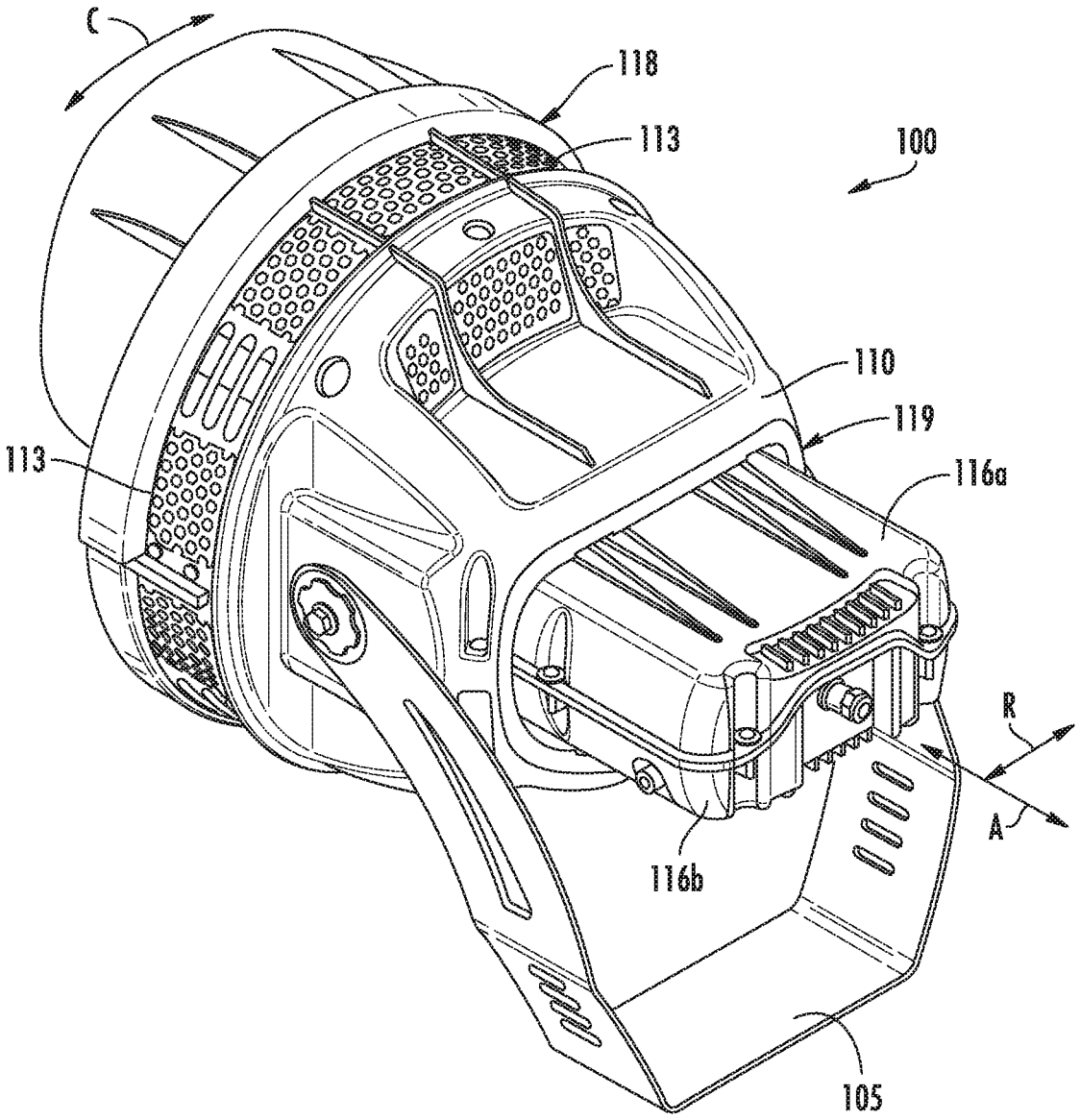
FIG. 3 is a rear, perspective view of an example reduced glare light fixture according to example embodiments of the present disclosure.
Figure 4:
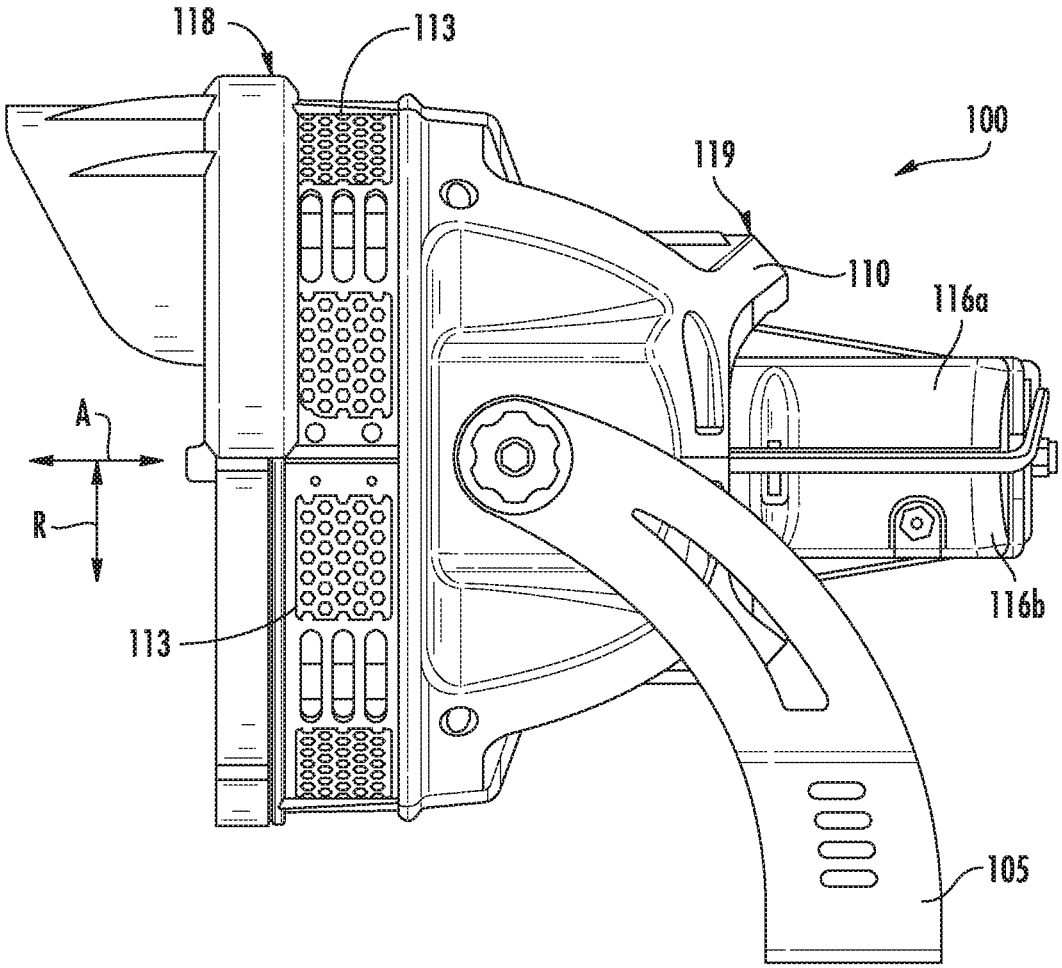
FIG. 4 is a side, elevation view of an example reduced glare light fixture according to example embodiments of the present disclosure.

Referring to FIGS. 1-15, and in particular to FIG. 2, an exploded, perspective view of an example embodiment of the reduced glare light fixture 100 according to the present disclosure is shown. In addition to the components introduced above, the reduced glare light fixture 100 includes a support body 140. The plurality of light engine modules 122 can be attached to the support body 140 within the housing 110. In some embodiments, the housing 110 is decorative. In some embodiments, for example, the plurality of light engine modules 122 are attached within housing 110 by one or more of fastening, snap-fitting, adhering, and other mechanisms of attachment. The support body 140 provides a shared structure for mounting and/or bearing the plurality of light engine modules 122 and/or plugs 150 within housing 110. In some embodiments, fasteners 142, such as bolts, extend through the support body 140 into the plurality of light engine modules 122 to mount the plurality of light engine modules 122 to the support body 140. In some embodiments, the fasteners 142 extend through support body 140 into the fins 114 on the heat sinks 112 to mount the plurality of light engine modules 122 to the support body 140. In some embodiments, the support body 140 forms a plurality of through-holes for the fasteners 142. In some embodiments, the reduced glare light fixture 100 includes a module back plate 144 positioned behind the support body 140. In some embodiments, the module back plate 144 includes a plurality of apertures for receiving the fasteners 142. In some embodiments, the through-holes are distributed in a pattern that provides a plurality of different mounting locations for the plurality of light engine modules 122 such that the plurality of light engine modules 122 are suitably spaced and/or oriented when mounted to the support body 140. In this fashion, the support body 140 provides a convenient layout and guide for mounting the plurality of light engine modules 122 within the housing 110. When the plurality of-lighting modules 122 have a common shape, the plurality of lighting modules 122 may be interchangeable with one another and/or manufactured with the same process.

In some embodiments, the upper driver casing 116*a* and the lower driver casing 116*b* include vertical fins 117, also known as ribs. In some embodiments, the vertical fins 117 are for heat dissipation, while in other embodiments the vertical fins 117 are decorative. In some embodiments, some of the upper driver casing 116*a*, lower driver casing 116*b*, housing 110, mounting yoke 105, yoke mount portion 111 of the housing, a back panel 115, the heat sinks 112, the bezel 123 and the optics 124 are made of materials suitable for direct exposure to outside conditions that include one or more of fresh water, salt water, temperature extremes, sunlight, animals, dust, debris, corrosive chemicals, combustible materials and explosive materials. In some embodiments, the housing 110 substantially protects the interior from at least one such outside condition.

As introduced above, in some embodiments the reduced glare light fixture 100 includes at least one spacer module known as a plug 150. In some embodiments, with less than the maximum number of the plurality of light engine modules 122 positioned within the housing 110, e.g., mounted on support plate 140, a separate plug 150 is positioned at a location of each omitted light engine module 122 within housing 110. In some embodiments, a plurality of plugs 150 are interspersed between the plurality of light engine modules 122. Thus, each plug 150 replaces each omitted light engine module 122 within housing 110. In some embodiments, the plug 150 is sized to match the light engine modules 122 such that plug 150 and the light engine modules 122 are interchangeable. In some embodiments, the plug 150 has suitable holes for receiving fasteners 142 at support plate 140 and/or a wedge shaped outer plate 152 that is positioned coplanar with LED devices. In this manner, the plug 150 enhances an appearance of the reduced glare light fixture 100 as opposed to leaving a void in place of the omitted light engine module 122. In some embodiments, one or more plugs 150 and one or more light engine modules 122 are distributed along the circumferential direction C at the front portion 118 of housing 110, and the one or more plugs 150 and light engine modules 122 cooperate to collectively form a front face of the reduced glare light fixture 100. In some embodiments, the plug(s) 150 and the light engine module(s) 122 collectively extend three hundred and sixty degrees (360°) along the circumferential direction C at the front portion 118 of housing 110. In some embodiments, the plugs 150 have an outer appearance that is identical to the light engine modules 122 except that the plugs 150 do not include LED devices. In some embodiments, each plug 150 is connected between adjacent light engine modules 122.

In some embodiments, the plurality of fins 114 on the heat sinks 112 are vertically aligned with the light engine modules 122 and are mounted on the support body 140 to provide the vertical flow paths 160. Vertical air flow paths 160 facilitate cooling air flow through the heat sinks 112 by enabling air heated by the LED devices to flow upwardly along vertical air flow paths 160 between fins 114 and cooler outside air is drawn into the vertical air flow paths 160.

In some embodiments, the reduced glare light fixture 100 includes an upper power circuit 200*a* and a lower power circuit 200*b*. In some embodiments, the reduced glare light fixture 100 combines the upper power circuit 200*a* and the lower power circuit 200*b* into a single power circuit 200. In some embodiments, the upper power circuit 200*a* and the lower power circuit 200*b* receive alternating current (AC) electrical power at a higher voltage and convert it to direct current (DC) electrical power at a lower voltage to energize the plurality of light engine modules 122. In some embodiments, the upper power circuit 200*a* and the lower power circuit 200*b* include one or more surge protective devices, transformers, and drivers. In some embodiments, the surge protector is configured to receive electrical current from an external power source such as a power grid or battery while protecting the reduced glare light fixture from one or more of electrical noise, spikes, lightning-induced surges and electrical anomalies.

In some embodiments, the reduced glare light fixture 100 includes a laser emitter 211. In some embodiments, the laser emitter 211 emits a laser beam used to assist with orienting the reduced glare light fixture 100. For example, a direction of the beam emitted by laser emitter 211 may generally correspond the direction of light emitted by LED system 120. An installer operates the laser emitter 211 and observes the beam emitted by laser emitter 211 to align the reduced glare the reduced glare light fixture 100 towards a desired location. In such a manner, LED system 120 may emit light in a desired direction after installation of the reduced glare light fixture 100.

Figure 14:
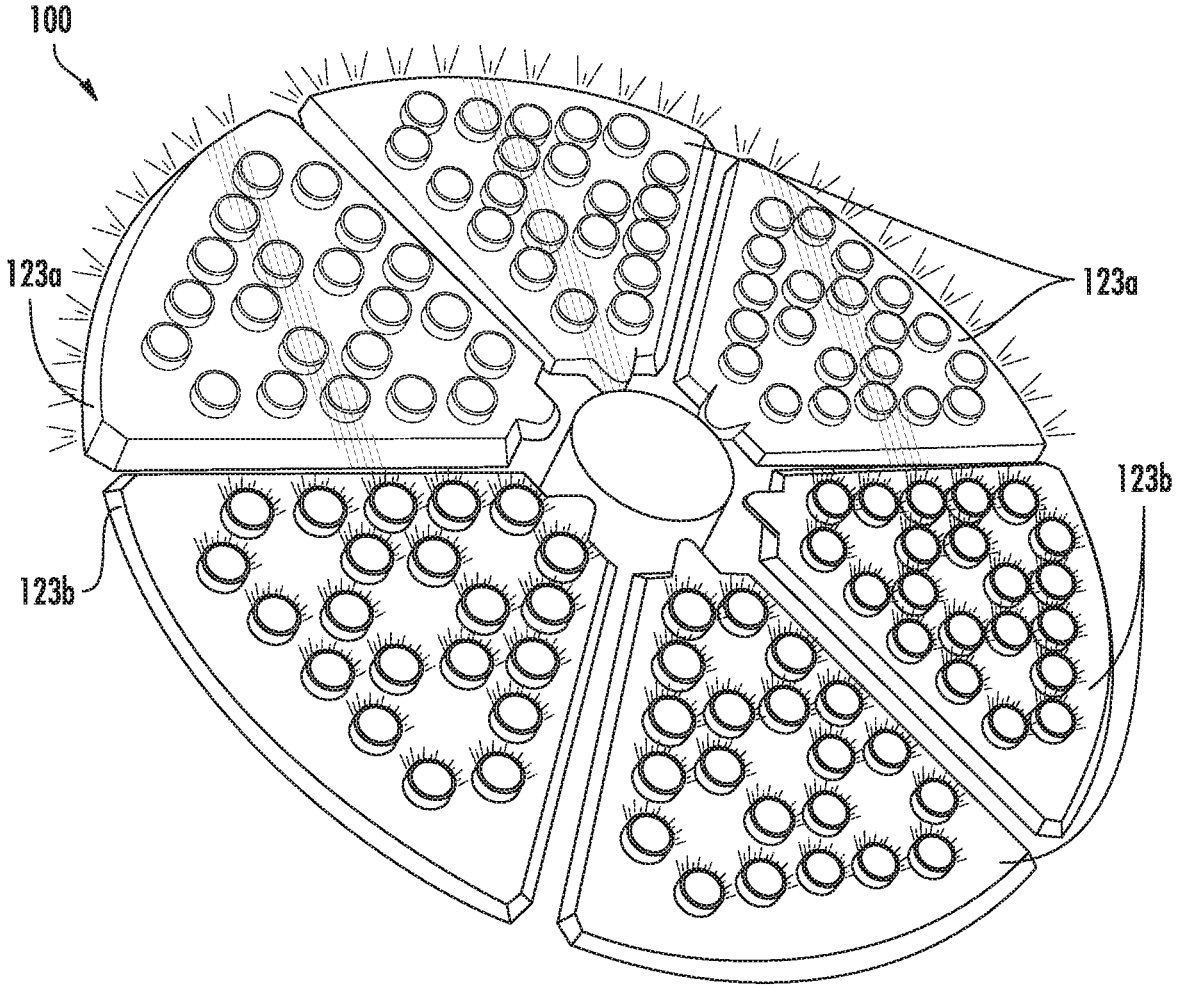
FIG. 14 is a front, perspective view of an active light engine module of an example reduced glare light fixture according to example embodiments of the present disclosure.

Referring to FIG. 14, a front, perspective view of active light engine modules of an embodiment of a reduced glare light fixture 100 according to the present disclosure is shown. For illustration purposes, the reduced glare light fixture 100 includes three modules each having a translucent bezel 123*a* and three modules each having an opaque bezel 123*b*. In some embodiments, the translucent bezel 123*b* is white. In some embodiments, the opaque bezel 123*b* is black. In some embodiments, the opaque bezel 123*b* is formed from a black material. In some embodiments, the opaque bezel 123*b* is coated with a black material. As shown in FIG. 14, the glare reduction tubes in the bezels 123*a* and 123*b* are positioned over and aligned with active LEDs emitting light. Glare is reduced as described herein in both the translucent bezels 123*a* and the opaque bezels 123*b*.

Figure 15:
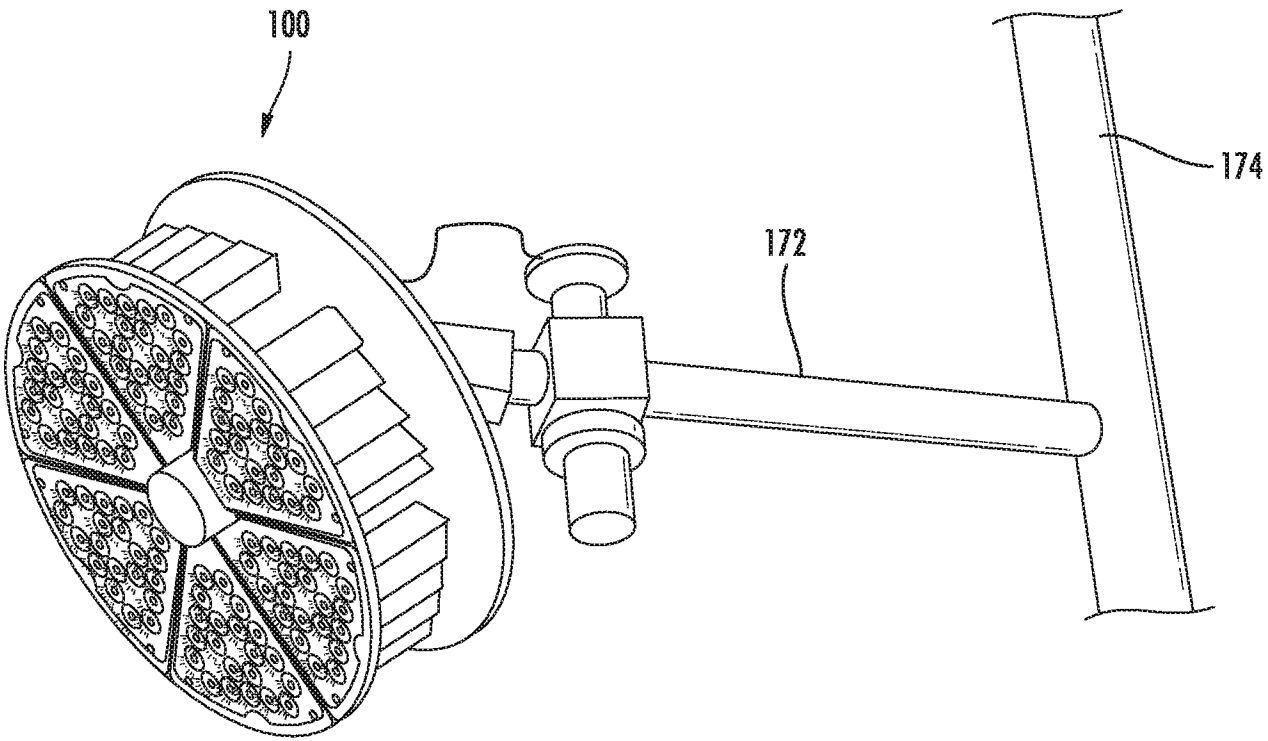
FIG. 15 is photographic view of an example reduced glare light fixture mounted in an outdoor environment according to example embodiments of the present disclosure.

Referring to FIG. 15, a photographic view of an illustrative embodiment of the reduced glare light fixture 100 mounted in an outdoor environment according to the present disclosure is shown. The reduced glare light fixture 100 mounted via a connecting pole (arm) 172 to a support pole 174. The arm 172 is positioned approximately horizontal with respect level ground and the support pole is positioned approximately vertical with respect to level ground. The reduced glare light fixture 100 is shown in an illuminated state against a mostly cloudy background.

Some embodiments herein describe a reduced glare light fixture including a light emitting diode (LED) system, wherein the LED system includes at least one LED module having a plurality of LED devices and a bezel physically coupled to the LED system engine, the bezel having a plurality of glare reduction tubes formed therein, at least one glare reduction tube configured to be approximately coaxial with one LED device.

Some other embodiments herein describe a reduced glare light fixture including a light emitting diode (LED) system, wherein the LED system includes a plurality of LED modules each including a plurality of LED devices. The reduced glare light fixture also includes a bezel physically coupled to the LED system, the bezel having a plurality of glare reduction tubes formed therein, at least one glare reduction tube configured to be approximately coaxial with one LED device and an optic, the optic configured to be approximately coaxial and optically coupled between the at least one glare reduction tube and the one LED device.

Some still other embodiments herein describe a reduced glare light fixture including a light emitting diode (LED) system, wherein the LED system includes a plurality of LED modules each including a plurality of LED devices and a plurality of plugs, wherein the plurality of LED modules and plurality of plugs are interspersed and arranged in a ring. The reduced glare light fixture also includes a bezel physically coupled to the LED system, the bezel having a plurality of glare reduction tubes formed therein, at least one glare reduction tube configured to be approximately coaxial with one LED device, and an optic, the optic configured to be approximately coaxial and optically coupled between the at least one glare reduction tube and the one LED device.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A light engine module, comprising:

a circuit board comprising at least a first light emitting source and a second light emitting source;

a bezel; and a plurality of glare reduction tubes disposed on the bezel, wherein:

the first light emitting source emits light into a first glare reduction tube of the plurality of glare reduction tubes; and the second light emitting source emits light into a second glare reduction tube of the plurality of glare reduction tubes.

2. The light engine module of claim 1, further comprising:

a first optic positioned within the first glare reduction tube; and a second optic positioned within the second glare reduction tube.

3. The light engine module of claim 1, wherein at least one of the plurality of glare reduction tubes comprises translucent material.

4. The light engine module of claim 1, wherein at least one of the plurality of glare reduction tubes comprises opaque material.

5. The light engine module of claim 1, wherein at least one of the plurality of glare reduction tubes is removably coupled to the bezel.

6. The light engine module of claim 1, wherein at least one of the plurality of glare reduction tubes is integrally formed with the bezel.

7. The light engine module of claim 1, wherein at least one of the first light emitting source and the second light emitting sources comprises a light emitting diode (LED) light source.

8. The light engine module of claim 1, wherein:

the plurality of glare reduction tubes extend from a surface of the bezel.

9. The light engine module of claim 8, wherein the surface of the bezel comprises an opaque material or a translucent material.

10. A bezel for a reduced glare light fixture, the bezel comprising:

a surface; and a plurality of glare reduction tubes disposed on the surface, wherein when the bezel is mounted to a circuit board comprising at least a first light emitting source and a second light emitting source:

the first light emitting source emits light into a first glare reduction tube of the plurality of glare reduction tubes; and the second light emitting source emits light into a second glare reduction tube of the plurality of glare reduction tubes.

11. The bezel of claim 10, wherein the surface comprises an opaque material.

12. The bezel of claim 10, wherein the surface comprises a translucent material.

13. The bezel of claim 10, wherein at least one of the plurality of glare reduction tubes comprise an opaque material.

14. The bezel of claim 10, wherein at least one of the plurality of glare reduction tubes comprises a translucent material.

15. The bezel of claim 10, wherein at least one of the plurality of glare reduction tubes is removably coupled to the surface.

16. A reduced glare light fixture, comprising:

a housing; and a light emitting diode (LED) module positioned within the housing, the LED module comprising:

a circuit board comprising at least a first light emitting source and a second light emitting source;

a bezel; and a plurality of glare reduction tubes disposed on the bezel, wherein:

the first light emitting source emits light into a first glare reduction tube of the plurality of glare reduction tubes; and the second light emitting source emits light into a second glare reduction tube of the plurality of glare reduction tubes.

* * * * *